US008166587B2

(12) United States Patent
Collins

(10) Patent No.: US 8,166,587 B2
(45) Date of Patent: May 1, 2012

(54) PORTABLE BREASTFEEDING AND NURSING PILLOW

(76) Inventor: Valerie N Collins, Tampa, FL (US)

( * ) Notice: Subject to any disclaimer, the term of this patent is extended or adjusted under 35 U.S.C. 154(b) by 86 days.

(21) Appl. No.: 12/366,331

(22) Filed: Feb. 5, 2009

(65) Prior Publication Data

US 2009/0199343 A1 Aug. 13, 2009

Related U.S. Application Data

(60) Provisional application No. 61/065,451, filed on Feb. 12, 2008.

(51) Int. Cl.
*A47D 13/02* (2006.01)

(52) U.S. Cl. ..... 5/655; 5/655.9; 5/657

(58) Field of Classification Search ..... 5/655, 655.7, 5/657, 731, 732; 108/43
See application file for complete search history.

(56) References Cited

U.S. PATENT DOCUMENTS 5,551,109 A * 9/1996 Tingley et al. ..... 5/655
5,937,465 A * 8/1999 Carew et al. ..... 5/732
5,963,998 A * 10/1999 Carew et al. ..... 5/655
6,061,854 A * 5/2000 Crowley ..... 5/655
6,484,337 B1 * 11/2002 Moe et al. ..... 5/652
6,659,545 B1 * 12/2003 McMillan ..... 297/153
7,454,808 B2 * 11/2008 Parrilla ..... 5/655

* cited by examiner

*Primary Examiner* — Michael Trettel

(57) ABSTRACT

A portable breastfeeding and nursing pillow for a baby includes a base portion in a generally rectangular shape with a contoured side. The base portion further includes a boarder about at least three sides of the base portion and extending a distance above a first feeding surface of the base portion for mitigating problems of the baby rolling off the first feeding surface. The top portion stacked underneath the base portion adds height if needed during the baby nursing time. The top portion also includes a second feeding surface for feeding the baby when additional height of the pillow without the boarder is desired. A strap is joined to the bottom portion for adjustably securing about a person's waist when the pillow is being used for breastfeeding or nursing a baby. The strap is adjustable for resting on a person's shoulder when transporting the pillow. A decorative binding strap holds the top portion to the bottom portion when transporting the pillow. Attachable nursing cover offers privacy during the nursing time.

20 Claims, 3 Drawing Sheets

PORTABLE BREASTFEEDING AND NURSING PILLOW

CROSS-REFERENCE TO RELATED APPLICATIONS

The present Utility patent application claims priority benefit of the U.S. provisional application for patent U.S. application Ser. No. 61/065,451, filed on Feb. 12, 2008 under 35 U.S.C. 119(e) by Valerija Nase Collins. The contents of this related provisional application are incorporated herein by reference for all purposes.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to infant supplies. More particularly, the invention relates to an easily portable, height adjustable, breastfeeding and nursing pillow and tote with a safety border.

BACKGROUND OF THE INVENTION

There are currently many known solutions for making the nursing of infants more comfortable for the infants and their mothers. However, these current solutions have problems and, in many cases, their function may be improved.

One such solution is a pillow with a half doughnut shape. Because of the semi-round shape, a nursing mother can only lean her arm on the pillow, and cannot place a baby to lie on the pillow while nursing. This causes back and arm pain for the mother because the full or partial weight of the baby is on her arms for a prolonged period of time while feeding the baby. Furthermore, if the baby is placed on the pillow, the baby tends to roll into the space between the mother and the pillow or roll away from the mother and off the pillow. The thickness of the pillow cannot be adjusted; therefore, it may work for some mothers and may not work for others. This pillow is also very inconvenient to carry in public and use away from home. Another known solution is an inflatable pillow with a half doughnut shape. Being inflatable enables the pillow to be height adjustable, and the pillow has a waist strap that keeps the pillow in a fixed position. However, since this pillow is inflatable, if there is not enough air in the pillow, it may not provide adequate support and if there is too much air in the pillow, it may be too rigid. Also, the baby may roll off of the pillow.

Another known solution is a fiber-filled nursing pillow. Since this pillow is filled with fiber, it has somewhat of an irregular shape and may provide unevenly distributed support for the baby. Furthermore, this pillow has no means for preventing the baby from rolling off of the pillow. Also, this pillow is inconvenient to carry and use outside the home and has no means for remaining in place on the mother during use.

Yet another currently known solution is a nursing pillow with a permanently attached cover. However, the nursing cover only partially covers the mother and only offers partial privacy. When the nursing cover is permanently attached to the nursing pillow, there is an inconvenience of having to use the nursing cover when it is not really needed, for example, at home or alone.

In view of the foregoing, there is a need for improved techniques for providing a breastfeeding and nursing pillow that is easily portable, height adjustable, has a safety border, and is comfortable for the baby and the mother.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1*a* is a front view of the nursing pillow in a transit mode. FIG. 1*b* is a back view of the nursing pillow in the transit mode. FIG. 1*c* is a front view of the nursing pillow in a nursing mode, and FIG. 1*d* is an exploded view illustrating the parts and structures of the nursing pillow;

FIG. 2*a* shows the first step in the transformation of the nursing pillow from the transit mode into the nursing mode, by positioning it on mom's lap and detaching the adjustable release buckle so that mom can wrap it around her waist, adjust the length, re-attach the buckle & get the nursing pillow into a secured, fixed position leaning against her stomach. FIG. 2*b* shows a binding strap being removed. FIG. 2*c* shows the nursing pillow in a thin setting of a nursing mode. FIG. 2*d* shows the nursing pillow in a thick setting of the nursing mode with a safety border, and FIG. 2*e* shows the nursing pillow in a thick setting of the nursing mode without a safety border; FIG. 3*a* shows a top view of the nursing cover when not in use. FIG. 2*b* shows the nursing cover attached to the nursing pillow, and FIG. 3*c* shows the nursing pillow with the nursing cover in use.

Figure 1:
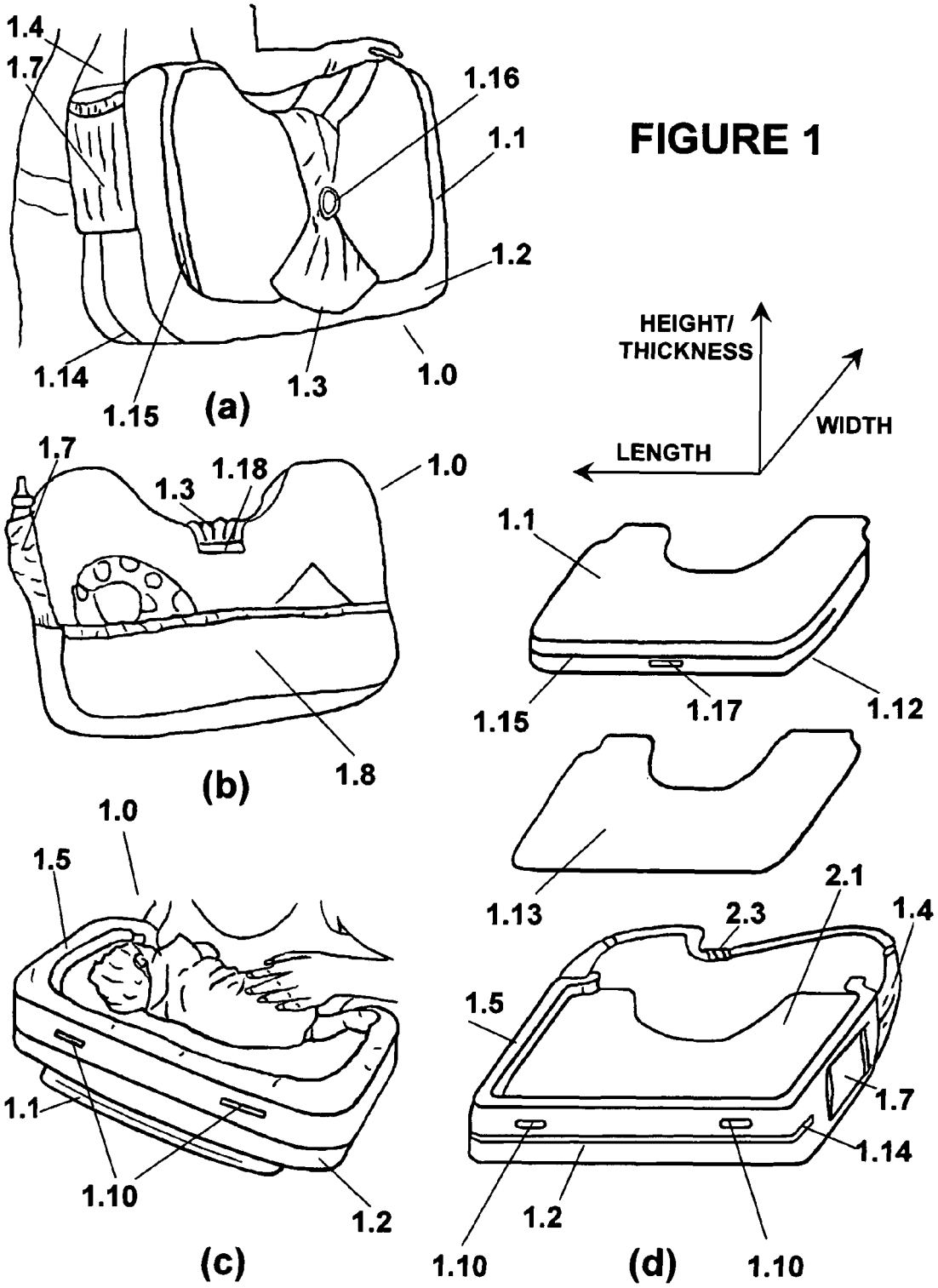
FIGS. 1*a*, 1*b*, 1*c*, and 1*d* illustrate an exemplary nursing pillow in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, portable breastfeeding and nursing pillow is presented.

In one embodiment, a portable breastfeeding and nursing pillow for a baby includes a base portion including a foam type material in a generally rectangular shape with a contoured side configured for placing about a person's abdomen, wrapped into a fabric pillowcase. The base portion further includes a boarder about at least three sides of the base portion and extending a distance above a first feeding surface of the base portion for mitigating problems of the baby rolling off the first feeding surface. A top portion includes a foam type material in a generally rectangular shape, wrapped into a pillowcase. The top portion has dimensions for substantially filling a volume defined by the boarder and the first feeding surface. The top portion further includes a second feeding surface for feeding the baby when additional height of the pillow without the boarder is desired. A strap is joined to the bottom portion for adjustably securing about a person's waist to bring the contoured side in contact with the person's abdomen when the pillow is being used for breastfeeding or nursing the baby. The strap is adjustable for resting on a person's shoulder when transporting the pillow. A decorative binding strap holds the top portion to the bottom portion when transporting the pillow. The optional, attachable nursing cover offers privacy during breastfeeding and/or nursing.

In another embodiment a portable breastfeeding and nursing pillow for a baby includes means for supporting a baby on a first feeding surface along with mitigating problems of the baby rolling off the first feeding surface, means for supporting the baby on a second feeding surface while providing additional height of the pillow, means for securing the pillow about a person's waist when the pillow is being used for breastfeeding or nursing the baby, and for resting on a person's shoulder when transporting the pillow, and means for keeping the nursing pillow in one, compact piece with the carry-on accessory characteristics, while the nursing pillow is being transported.

In another embodiment a portable breastfeeding and nursing pillow for a baby includes a base/bottom portion including a foam type material in a generally rectangular shape with a contoured side configured for placing about a person's abdomen. The base portion further includes a boarder about at least three sides of the base portion and extending a distance above a first feeding surface of the base portion for mitigating problems of the baby rolling off the first feeding surface. A removable base/bottom pillowcase covers the base/bottom portion. The base pillowcase includes a soft fabric material with a waterproof surface at the part that covers the first baby feeding surface and a plurality of pockets for carrying baby accessories. A top portion includes a foam type material in a generally rectangular shape. The top portion has dimensions for substantially filling a volume defined by the boarder and the first feeding surface. The top portion further includes a second feeding surface for feeding the baby when additional height of the pillow without the boarder is desired. A removable top pillowcase covers the top portion. The removable top pillowcase may include a soft fabric material with a waterproof surface to cover the second baby feeding surface. A strap is joined to the bottom portion for adjustably securing about a person's waist to bring the contoured side in contact with the person's abdomen when the pillow is being used for breastfeeding or nursing the baby. The strap is adjustable for resting on a person's shoulder when transporting the pillow. A decorative binding strap holds the top portion to the bottom portion when transporting the pillow. The decorative binding strap wraps around a mid portion of the pillow and removably joins to the top pillowcase and the bottom pillowcase. Other embodiments further include a nursing cover to form a canopy over the baby and provide privacy during breastfeeding, and at least one pillow topper for protecting the bottom pillowcase or the top pillowcase when feeding the baby.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Preferred embodiments of the present invention provide a comfortable and safe nursing experience for a baby by providing pillows to help mothers and/or fathers in positioning their babies in a comfortable pose for a breastfeeding and/or feeding process. Preferred embodiments also provide a large amount of carry-on space for all of the baby accessories that may be needed away from home and are lightweight and easy to transport. Preferred embodiments also may have an attractive look in the public eye so that mothers actually enjoy carrying the pillow. Preferred embodiments may also provide mothers with a nursing cover for privacy while breastfeeding a baby, when needed. Preferred embodiments are large enough for a baby to fit within a border around the edge of the nursing pillow, yet are small enough so that they are not inconvenient to carry from place to place.

FIGS. 1*a*, 1*b*, 1*c*, and 1*d* illustrate an exemplary nursing pillow 1.0 in accordance with an embodiment of the present invention. FIG. 1*a* is a front view of nursing pillow 1.0 in a transit mode. FIG. 1*b* is a back view of nursing pillow 1.0 in the transit mode. FIG. 1*c* is a front view of nursing pillow 1.0 in a nursing mode, and FIG. 1*d* is an exploded view illustrating the parts and structures of nursing pillow 1.0. In the present embodiment, nursing pillow 1.0 comprises two foam pieces, a top piece 1.1 and a base 1.2, a binding strap 1.3, and a waist and shoulder strap 1.4. Nursing pillow 1.0 works in two basic modes, the transit mode, shown by way of example in FIGS. 1*a* and 1*b*, while nursing pillow 1.0 is being carried around and the nursing mode, shown by way of example in FIGS. 1*c*, 2*c*, 2*d*, and 2*e*, in which nursing pillow 1.0 may be used while feeding a baby. The elements of nursing pillow 1.0 are assembled to form a clamshell design that enables an easy transformation from the transit mode, in which nursing pillow 1.0 looks and functions as a carry-on accessory or tote, to the nursing mode, in which nursing pillow 1.0 functions as a height adjustable, nursing pillow with a safety border 1.5. Base 1.2 and top piece 1.1 are used to adjust the height (i.e., thickness) to two different height levels, so that mothers of different heights and sizes can choose which height is more appropriate for them. Base 1.2 provides means for supporting the baby on a first feeding surface. Top piece 1.1 provides means for supporting the baby on a second feeding surface. Also, mothers may need a support (i.e., pillow) of a different thickness depending on where they are sitting. For example, if the mother is sitting in a soft and cushiony place, they will more likely need a thinner pillow. The present embodiment also comprises attachment straps 1.10 for an optional nursing cover that provides privacy when breastfeeding.

In the present embodiment, the foam pieces making base 1.2 and top piece 1.1 are covered with fabric nursing pillowcases comprising zippers 1.14 and 1.15. This enables the nursing pillowcases to be easily washed by taking the foam pieces out of the nursing pillowcases and washing just the nursing pillowcases. Nursing pillowcases may be made of various different fabrics and are preferably non-shrinkable when washed. Otherwise, the pillowcases may not fit back properly on the foam pieces of base 1.2 and/or top piece 1.1. The nursing pillowcase for base 1.2 comprises multiple pockets including two side pockets 1.7 and a large back pocket 1.8. Large back pocket 1.8 can have elastic on the top edge supported by a piece of hook and loop joining means (e.g., Velcro™), as shown by way of example in FIG. 1*b*, or in alternate embodiments the large back pocket may comprise a zipper at the top edge.

The tote look of nursing pillow 1.0 in the transit mode is created by shaping base 1.2 and top piece 1.1 similarly to a handbag or tote and is enhanced by side pockets 1.7 and back pocket 1.8. Also, length-adjustable waist and shoulder strap 1.4 attached to the nursing pillowcase covering base 1.2 enables nursing pillow 1.0 to be carried like a tote when in the transit mode. The portions of the nursing pillowcases that cover the area on which the baby lies while breastfeeding, the baby feeding surface 1.12 on top piece 1.1 and baby feeding surface 2.1 on the base 1.2, are preferably made out of soft, absorbent, waterproof, natural fabric to provide comfort for the baby and protect the foam within the nursing pillowcases. In some embodiments the baby feeding surfaces may be made out of rubberized flannel, which is cotton/PVC bonded fabric. In the nursing mode, it is optional, but recommended to use a pillow topper 1.13, which is laid on top of a feeding surfaces 1.12 or 2.1 to protect the nursing pillowcases from "little accidents". Pillow topper 1.13 may be made out of 1 or 2-sided rubberized flannel. Other types of fabrics bonded with waterproof materials may also be used. By adding an emblem, pattern or embroidery on the pillow toppers, a variety of looks can be achieved. Pillow toppers may also be sewn together and stacked with the other types of fabrics for softness and a variety of patterns.

In order to put nursing pillow 1.0 in the transit mode, top piece 1.1 fits into an opening in base 1.2 created by safety boarder 1.5, and in addition to this, binding strap 1.3 and a hook and loop joining (e.g., Velcro™) strap 1.17 are used to hold top piece 1.1 and base 1.2 together securely. hook and loop (e.g., Velcro™) strap 1.17 connects top piece 1.1 to safety border 1.5 of base 1.2, as shown by way of example in FIG. 1*d*. Binding strap 1.3 is attached to both the front and the back of nursing pillow 1.0 in the transit mode. On the front of nursing pillow 1.0, binding strap 1.3 is connected by a fastener, for example without limitation, a piece of hook and loop (e.g., Velcro™) 2.2, shown by way of example in FIGS. 2*b* and 2*c*, or a snap, to the nursing pillowcase covering top piece 1.1. On the back side of nursing pillow 1.0, binding strap 1.3 is connected by a hook and loop (e.g., Velcro™) strap 1.18 to the nursing pillowcase covering base 1.2. In the nursing mode, binding strap 1.3 is not needed and may be completely detached. Binding strap 1.3 is preferably decorative to add to the tote look of nursing pillow 1.0 and comprises a decorative buckle 1.16 that may be made out of plastic, alloy with rhinestone or many other materials. Decorative buckles in alternate embodiments may be various different shapes other than the round/oval shape shown, by way of example, in FIG. 1*a*. Binding strap 1.3 can be made out of the same fabric that the nursing pillowcases are made of or may be made of different fabrics or patterns that will give different kinds of looks to the whole appearance of nursing pillow 1.0.

Figure 2:
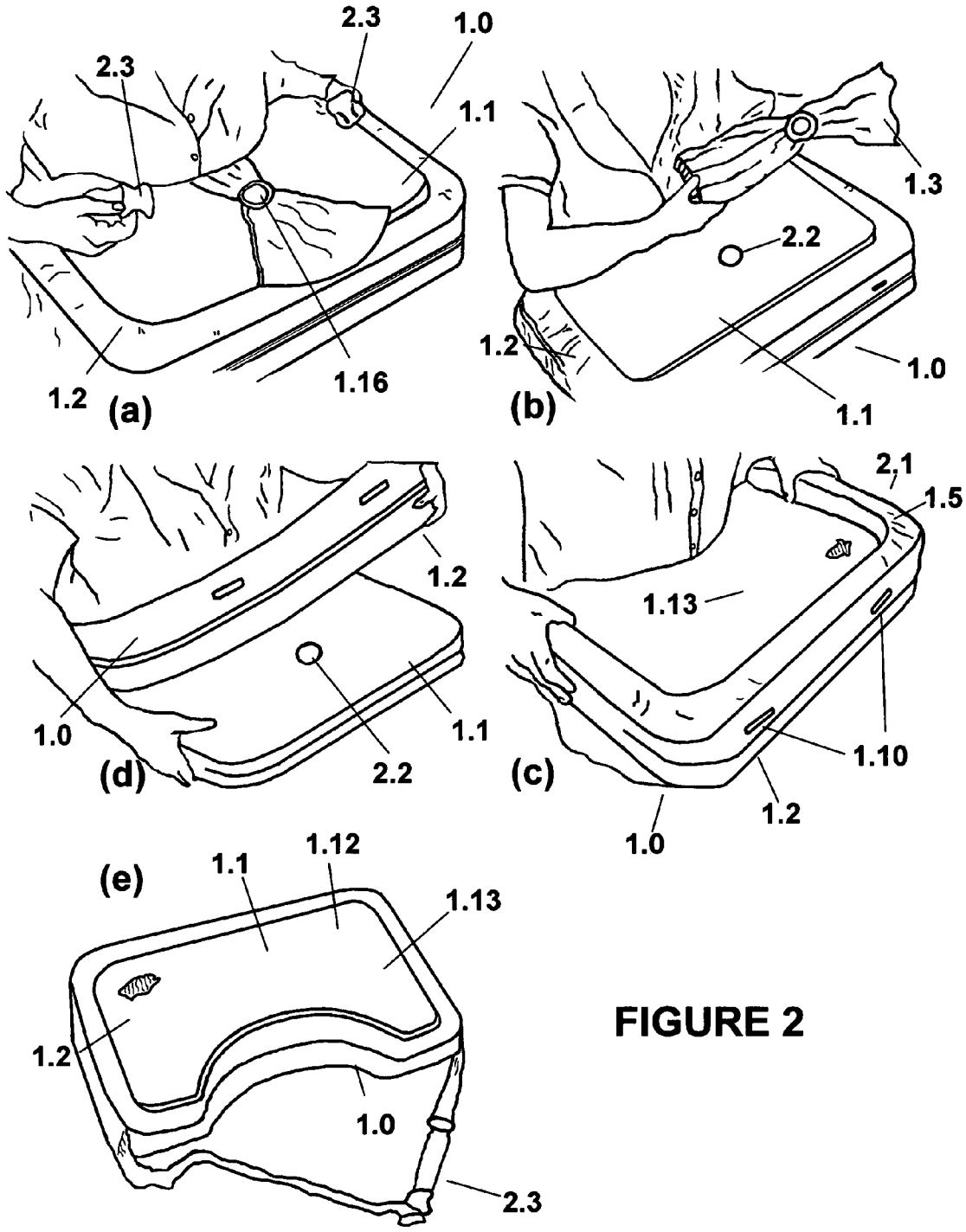
FIGS. 2*a*, 2*b*, 2*c*, 2*d*, and 2*e* illustrate an exemplary nursing pillow in various modes of use and height settings, in accordance with an embodiment of the present invention.

FIGS. 2*a*, 2*b*, 2*c*, 2*d*, and 2*e* illustrate an exemplary nursing pillow 1.0 in various modes of use and height settings, in accordance with an embodiment of the present invention. FIG. 2*a* shows nursing pillow 1.0 being positioned with an adjustable release buckle 2.3. FIG. 2*b* shows a binding strap 1.3 being removed. FIG. 2*c* shows nursing pillow 1.0 in a thin setting of a nursing mode. FIG. 2*d* shows nursing pillow 1.0 in a thick setting with a safety border 1.5, and FIG. 2*e* shows nursing pillow 1.0 in a thick setting without a safety border. In the present embodiment waist and shoulder strap 1.4 that is provided for means for easy conversion in the transit mode turns into means for a length adjustable waist strap in the nursing mode. Referring to FIG. 2*a*, release buckle 2.3 enables a user to adjust the length of strap 1.4 to fit comfortably around a mother's waist and generally keep nursing pillow 1.0 in a fixed, secured position, leaning on the mother's stomach while a baby is being fed. In some embodiments, waist and shoulder strap 1.4 may require an interlining material to achieve a certain thickness as waist and shoulder strap 1.4 must be thick enough to have enough resistance going through the release buckle 2.3 so that it does not slip trough release buckle 2.3. Release buckle 2.3 is preferably made of plastic; however, alternate materials such as, but not limited to various metals may be used As previously described, there are two basic working modes for nursing pillow 1.0, the transit mode and the nursing mode. When the mother is ready to feed her baby, she can put nursing pillow 1.0 on her lap, detach waist and shoulder strap 1.4 by using release buckle 2.3, put waist and shoulder strap 1.4 around her waist, close release buckle 2.3, and adjust the length of waist and shoulder strap 1.4 to fit well around her waist, as shown by way of example in FIG. 2*a*. Next, the mother removes binding strap 1.3 that is not used in the nursing mode by detaching binding strap 1.3 from a hook and loop (e.g., Velcro™) piece 2.2 on the front of nursing pillow 1.0 and a hook and loop (e.g., Velcro™) piece 1.18, on the back of the nursing pillow 1.0, as shown by way of example in FIG. 2*b*. Then, the mother removes a top piece 1.1. Depending on how a base 1.2 and top piece 1.1 are used while feeding the baby, there are three different possible settings in the nursing mode, a thin setting, as shown by way of example in FIG. 2*c*, a thick setting with safety boarder 1.5, as shown by way of example in FIG. 2*d*, and a thick setting without a safety border, as shown by way of example in FIG. 2*e*. In the thin setting of the nursing mode, the mother lays her baby on a feeding surface 2.1 on base 1.2 and uses just base 1.2 while feeding. Safety border 1.5 is around the nursing baby in this mode. In the thick setting with safety border 1.5, the mother lays the baby on feeding surface 2.1 on base 1.2 and stacks top piece 1.1 underneath base 1.2, giving nursing pillow 1.0 extra height. Safety border 1.5 is around the nursing baby in this mode. The mother also has the option of using nursing pillow 1.0 without safety border 1.5 at the thicker of the adjustable heights. In the thick setting without a safety border, the mother inserts top piece 1.1 into base 1.2 and lays the baby on a feeding surface 1.12 of top piece 1.1 using the full pillow height. A safety border is not around a nursing baby in this mode, which may make this mode more desirable for some older or larger babies.

Safety border 1.5 has the function of protecting the baby from rolling away from the mother and off nursing pillow 1.0, which is a big help especially for inexperienced, first time mothers. Safety border 1.5 also surrounds top piece 1.1 allowing top piece 1.1 to fit comfortably into a "clamshell" design for easy transportation in the transit mode. Safety border 1.5 also surrounds top piece 1.1 and generally keeps top piece 1.1 in a fixed position while a baby is feeding at the top of the stacked foam pieces in the thick setting without a safety border.

Optional pillow toppers, such as, but not limited to, pillow topper 1.13 shown by way of example in FIG. 1*d*, for feeding surfaces are small, flat or mostly flat, waterproof surfaces that protect the nursing pillowcases and can be frequently changed and washed. Pillow toppers are highly recommended for use on feeding surfaces 2.1 and 1.12 of base 1.2 and top piece 1.1, respectively, for easy clean up. Pillow toppers reduce the need to frequently wash the entire nursing pillowcase and hence, extend the fresh, new look of nursing pillow 1.0 for a longer time.

Figure 3:
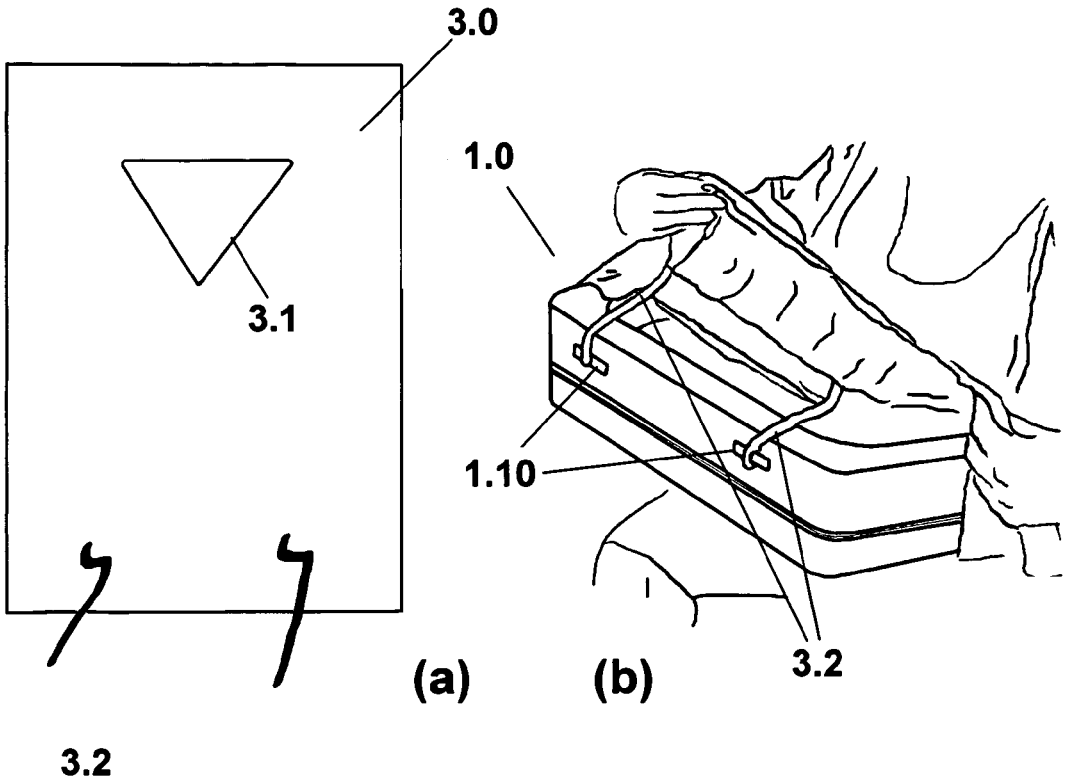
FIGS. 3*a*, 3*b* and 3*c* illustrate an exemplary nursing cover for use with a nursing pillow, in accordance with an embodiment of the present invention.
Figure 3:
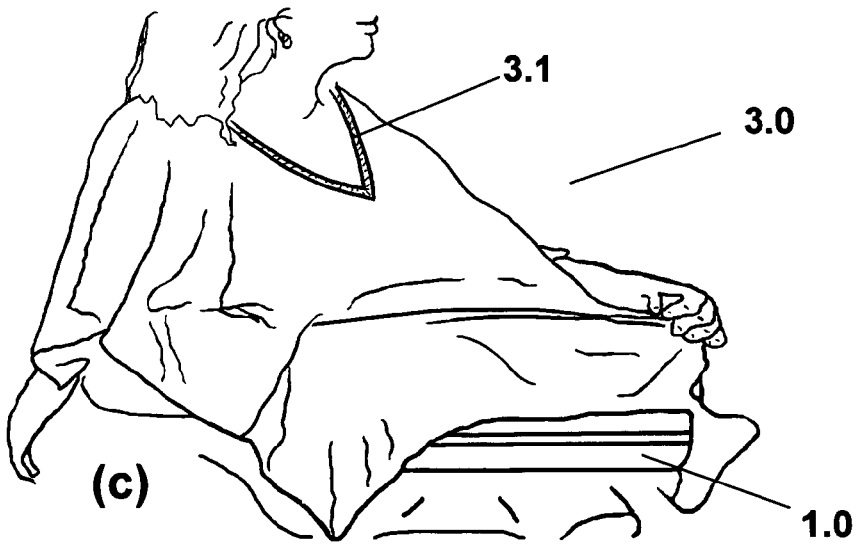

FIGS. 3*a*, 3*b* and 3*c* illustrate an exemplary nursing cover 3.0 for use with a nursing pillow 1.0, in accordance with an embodiment of the present invention. FIG. 3*a* shows a top view of nursing cover 3.0 when not in use. FIG. 3*b* shows nursing cover 3.0 attached to nursing pillow 1.0, and FIG. 3*c* shows nursing pillow 1.0 with nursing cover 3.0 in use. While using nursing pillow 1.0 in any of the above-described settings in the nursing mode, mothers can attach nursing cover 3.0 to achieve some privacy while feeding their babies. Nursing cover 3.0 is preferably made out of a very light, airy fabric that provides the best environment for a nursing baby. Nursing cover 3.0 has a neck opening 3.1 that is meant to go over the mother's head. A few inches from the bottom end of nursing cover 3.0 two nursing cover straps 3.2 are sewn into nursing cover 3.0. Hook and loop (e.g., Velcro™) is added all along the lengths of nursing cover straps 3.2. In typical use, nursing cover straps 3.2 are looped around nursing cover attachment straps 1.10 on nursing pillow 1.0 and then attached to themselves. This enables mothers to adjust the tension on nursing cover 3.0, which depends on the size and length of the mother's torso. Because of the tension created between the mother's neck on one side and nursing cover straps 1.10 and/or 3.2, nursing cover 3.0 canopies over the baby as opposed to "leaning on" the baby, as is the case with most of the existing nursing covers. Using nursing cover straps 3.2, an appropriate amount or length of fabric can be kept between the mother's neck and the end of nursing cover 3.0 attached to nursing pillow 1.0 so that nursing cover 3.0 does not pull on the mother's neck and it also does not get so loose that it falls over the baby's face and body. The perfect attachment of nursing cover 3.0 to nursing pillow 1.0 enables the fabric of nursing cover 3.0 to leisurely lay on the mother's shoulders on one side and the border of nursing pillow 1.0 on the other side, going over and not touching the baby, as shown by way of example in FIG. 3*c*.

Preferred embodiments of the present invention will be most useful to nursing mothers; however, fathers and other caretakers can also use them to bottle feed babies. Parents and caregivers can also use nursing pillows in accordance with embodiments of the present invention, in the nursing mode as a comfortable place to lay babies during leisurely, sitting time (i.e., while watching TV, having friend or family gatherings, etc.). The nursing pillow can be placed on a user's lap so the user can easily keep an eye and hands on the baby. The weight of the nursing pillow with the baby on it rests on the user's lap and the pillow is securely in the fixed position by using the adjustable waist and shoulder strap. In an alternate use, the base and the top piece can be placed next to each other on a horizontal surface to create a large flat area with the safety border around the upper body area of the baby. This soft, clean, large surface can be used as a changing pad for changing a baby while "out and about".

An alternate embodiment of the present invention may be implemented as a PC carrier/Tote. In the transit mode, the additional space can be allowed/made for the laptop computer to fit into. Instead of the soft, waterproof feeding surfaces 1.12 and/or 2.1, there can be a hard plastic surface or alternative material that would give enough support, but not cause scratches and/or any other damage on the laptop. While in transit, this carrier will have the similar look to the nursing pillow and tote invention. When the person wants to use their laptop, they would remove the binding strap or alternative means of holding the compact shape of the pillow in transit, take the top portion, turn it around for 180 degrees and fit it back into the base portion. The plastic cover will now be exposed and the laptop can be placed on it. At the same time, the soft base part of the pillow will offer comfort while holding a PC on the pillow on their lap and the height that the person might need to work on the laptop. The height can be adjusted to two different settings and the safety border can be used in the similar way of using two foam pieces, as already explained in this patent disclosure Having fully described at least one embodiment of the present invention, other equivalent or alternative methods of implementing a nursing pillow for providing a comfortable and safe nursing experience for babies and parents according to the present invention will be apparent to those skilled in the art. The invention has been described above by way of illustration, and the specific embodiments disclosed are not intended to limit the invention to the particular forms disclosed. For example, the particular implementation of the base and top piece may vary depending upon the particular type of material used. The base and top piece described in the foregoing were directed to foam implementations; however, similar techniques are to make the base and top piece from various different materials such as, but not limited to, plastic with cushions, fiber filled forms, etc. Implementations of the present invention comprising materials other than foam are contemplated as within the scope of the present invention. The invention is thus to cover all modifications, equivalents, and alternatives falling within the spirit and scope of the following claims.

What is claimed is:

1. A portable breastfeeding and nursing pillow for a baby comprising:

a base portion comprising a foam type material in a generally rectangular shape with a contoured side configured for placing about a person's abdomen, said base portion further comprising an optionally detachable, flexible width border about at least three sides of said base portion and extending a desirable, alterable distance above a first feeding surface of said base portion for mitigating problems of the baby rolling off said first feeding surface;

a top portion comprising a foam type material in a generally rectangular shape, said top portion having dimensions for substantially filling a volume defined by said border and said first feeding surface, said top portion further comprising a second feeding surface for feeding the baby when additional height of the pillow without said border is desired;

a base pillowcase for covering said base portion;

a top pillowcase for covering said top portion;

a strap joined to said base portion for providing convenience of transporting the pillow; and a binding strap for holding said top portion to said base portion when transporting the pillow.

2. The portable breastfeeding and nursing pillow as recited in claim 1, further comprising:

said base pillowcase for covering said base portion, said base pillowcase comprising a single large pocket all along the said base longest edge and/or plurality of pockets for carrying significant amount of baby accessories; and said strap joined to said base portion for adjustably securing about a person's waist, to bring said contoured side in contact with said person's abdomen when the pillow is being used for breastfeeding or nursing the baby, and said strap being adjustable for resting on a person's shoulder when transporting the pillow.

3. The portable breastfeeding and nursing pillow as recited in claim 1, wherein said base pillowcase and said top pillowcase each comprises a soft material with a waterproof surface for protecting the base portion and the top portion of the pillow or at least covering said first and/or second baby feeding surfaces.

4. The portable breastfeeding and nursing pillow as recited in claim 1, wherein said base pillowcase and said top pillowcase each comprises a zippered opening for removing and replacing said respective portions.

5. The portable breastfeeding and nursing pillow as recited in claim 1, further comprising:

a nursing cover comprising a large piece of fabric further comprising a neck opening for receiving a person's head and at least one nursing cover attachment point and/or strap for adjustably joining to said base portion to form a canopy over the baby and provide privacy during breastfeeding; and said base pillowcase comprising at least one base attachment point and/or strap for attaching said nursing cover.

6. The portable breastfeeding and nursing pillow as recited in claim 5, wherein said nursing cover further comprises a light airy material.

7. The portable breastfeeding and nursing pillow as recited in claim 1 further comprising at least one pillow topper comprising a PVC bonded cotton or other waterproof fabric and/or two pieces of fabrics, attached on the top of each other and with fiber or other soft, shape adjustable filling between them, for making a soft, absorbent surface for a baby to lie on and the waterproof surface for protecting said first and/or second feeding surface from food leaks during feedings and prevent possible bacteria development in the said base and/or top portion.

8. The portable breastfeeding and nursing pillow as recited in claim 1, wherein said binding strap can be made in different decorative shapes, out of variety of fabrics and decorative buckles of different shapes and materials.

9. The portable breastfeeding and nursing pillow as recited in claim 1, wherein said binding strap wraps around a mid portion of the pillow and joins the said top pillowcase and said base pillowcase while in transit, wherein, detaching said binding strap, releases two foam pieces thereby enabling the easy transformation of said nursing pillow from transit mode into a nursing mode.

10. The portable breastfeeding and nursing pillow as recited in claim 1, wherein said top portion and said base portion further comprise at least one hook and loop joining means for joining said top portion to said base portion and/or attaching said border to said first feeding surface.

11. The portable breastfeeding and nursing pillow as recited in claim 5, further comprising:

means for supporting a baby on said second feeding surface formed by said top portion placed on the top of the said first feeding surface of the said base thereby forming a single block shape with contoured side configured for placing about person's abdomen, with a large predominantly flat top surface, not surrounded by any borders; and means for attaching said means for supporting a baby on a said second feeding surface to said nursing cover.

12. The portable breastfeeding and nursing pillow as recited in claim 11 further comprising said nursing cover comprising said neck opening for receiving a person's head and at least one said nursing cover attachment point and/or strap for attaching said nursing cover to said base with a goal of forming a canopy over the baby and providing airy environment for the baby and privacy during breastfeeding.

13. The portable breastfeeding and nursing pillow as recited in claim 11 further comprising means for protecting said means for covering said means for supporting the baby on a first feeding surface or said means for covering said means for supporting the baby on a second feeding surface when feeding the baby.

14. The portable breastfeeding and nursing pillow as recited in claim 12, further comprising said nursing cover with at least one, preferably two adjustable length fastening straps used for attaching said nursing cover to said base attachment points and/or straps on said base pillowcase, in such way to create tension between said nursing cover attachment strap/straps and said neck opening portion of the said nursing cover and enable a particular mom appropriate length/size canopy to be made over a baby, for moms of different height and torso lengths.

15. A portable breastfeeding and nursing pillow for a baby comprising:

a base portion comprising a foam type material in a generally rectangular shape with a contoured side configured for placing about a person's abdomen, said base portion further comprising a border about at least three sides of said base portion and extending a distance above a first feeding surface of said base portion;

a removable base pillowcase for covering said base portion, said base pillowcase optionally comprising a soft fabric material with a waterproof surface covering a first baby feeding surface and optional plurality of pockets for carrying baby accessories;

a top portion comprising a foam type material in a generally rectangular shape, said top portion having dimensions for substantially filling a volume defined by said border and said first feeding surface, said top portion further comprising a second feeding surface for feeding the baby when additional height of the pillow without said border is desired;

a removable top pillowcase for covering said top portion, said removable top pillowcase comprising a soft fabric material with a full or partially waterproof surface;

a strap joined to said base portion for adjustably securing about a person's waist to bring said contoured side in contact with said person's abdomen when the pillow is being used for breastfeeding or nursing the baby, and said strap being adjustable in length for resting on a person's shoulder when transporting the pillow; and a binding strap for holding said top portion to said base portion when transporting the pillow, said binding strap wrapping around a mid portion of the pillow and removably joining to said top pillowcase and said base pillowcase.

16. A portable breastfeeding and nursing pillow for a baby comprising:

a base portion comprising a foam type material in a generally rectangular, half-doughnut or moon shaped three-dimensional shape, with one contoured side configured for placing about a person's abdomen and at a feeding surface for supporting a baby during feedings; said base portion further comprising an optional border, extending a distance above said first feeding surface, where presence of said border, balances the need to prevent a baby from rolling off said first feeding surface and need to maximize the length and/or area of the said first feeding surface, for older and/or larger babies;

a top portion comprising a foam type material of generally rectangular, half-doughnut or moon shape of alterable height, width and/or thickness, said top portion having dimensions for substantially filling a volume defined by said border and/or said first feeding surface; said top portion further comprising a second feeding surface for feeding a baby when additional height and/or predominantly flat feeding surface of the pillow without said border is desired;

a base pillowcase for covering said base portion;

a top pillowcase for covering said top portion;

a strap joined to said base pillowcase for providing convenience of transporting the said nursing pillow; and a binding strap for connecting and/or holding together said top portion and said base portion when transporting the said nursing pillow.

17. The portable breastfeeding and nursing pillow as recited in claim 16, further comprising:

said strap joined to said base pillowcase for securing about a person's waist, to keep said contoured side in contact with said person's abdomen when the pillow is being used for breastfeeding or nursing the baby thereby preventing a baby from rolling between the said pillow and said person's abdomen;

and a said strap being adjustable length and thereby provide a comfortable resting on a shoulder of persons of different heights and/or sizes, when transporting the said pillow.

18. The portable breastfeeding and nursing pillow as recited in claim 16, further comprising:

a single large pocket, with length equal or up to the length of the said base, optionally with a zipper to prevent baby accessories from falling out and/or plurality of small pockets on the said base and/or top pillowcase, for carrying baby accessories.

19. A portable breastfeeding and nursing pillow for a baby comprising:

a base portion made out of foam type material or combination of materials that can form a soft to semi-firm three dimensional shape with at least one predominantly flat feeding surface used for supporting a baby during feedings, further comprising a contoured side configured for placing about a person's abdomen;

a single or multiple attachment points and/or straps on the base portion for attaching a nursing cover;

a nursing cover comprising a large piece of fabric further comprising neck opening for receiving a person's head and at least-one said attachment point and/or strap for joining to said base portion to form a canopy over a nursing baby and provide privacy during breastfeeding and airy environment for a nursing baby; and an optional strap joined to said base for providing convenience of transporting the said nursing pillow.

20. The portable breastfeeding and nursing pillow as recited in claim 19, further comprising:

said strap joined to said base portion for adjustably securing about a person's waist, to bring said contoured side in contact with said person's abdomen when the pillow is being used for breastfeeding or nursing the baby, and said strap being adjustable for resting on a person's shoulder when transporting the pillow.

* * * * *